United States Patent [19]

Abe et al.

[11] Patent Number: 4,763,466

[45] Date of Patent: Aug. 16, 1988

[54] STEEL CORD FOR RADIAL TIRE

[75] Inventors: Hideo Abe; Takaaki Hira; Toru Sasaki; Keiji Kumagai; Kunihiko Kataoka; Takashi Sasaki, all of Chiba, Japan

[73] Assignees: Kawasaki Steel Corporation, Kobe; Kawatetsu Wire Products Co., Ltd., Tokyo, both of Japan

[21] Appl. No.: 904,772

[22] Filed: Sep. 5, 1986

Related U.S. Application Data

[63] Continuation of Ser. No. 674,857, Nov. 26, 1984, abandoned.

[30] Foreign Application Priority Data

Dec. 29, 1984 [JP] Japan ..... 58-250309

[51] Int. Cl.[4] ..... D02G 3/48; D07B 1/06

[52] U.S. Cl. ..... 57/213; 57/215; 57/902; 152/451; 152/556; 152/560; 245/1.5

[58] Field of Search ..... 152/451, 556, 559, 560, 152/561, 527, 548; 57/212, 213, 215, 218, 902; 245/1.5

[56] References Cited

U.S. PATENT DOCUMENTS

| | | | |
|---|---|---|---|
| 2,492,352 | 12/1949 | Bourdon | 57/215 |
| 3,922,842 | 12/1975 | Katsumata et al. | 57/215 |
| 4,158,946 | 6/1979 | Bourgois | 152/451 X |
| 4,349,063 | 9/1982 | Kikuchi et al. | 152/359 |

*Primary Examiner*—David Simmons
*Assistant Examiner*—Thomas Bokan
*Attorney, Agent, or Firm*—Balogh, Osann, Kramer, Dvorak, Genova & Traub

[57] ABSTRACT

A steel cord comprising at least 10 metal filaments and having an elongation of 0.015–0.045% under a load of 0.5 kgf, an elongation of 0.025–0.060% under a load 1 kgf, and an elongation of 0.060–0.114% under a load of 4 kgf, assuming that the elongation under a load of 0.05 kgf is 0%, has a soft twist construction and is suitable to be used in the carcass of a radial tire for truck and bus.

1 Claim, 5 Drawing Sheets

STEEL CORD FOR RADIAL TIRE

This application is a continuation of application Ser. No. 674,857, filed Nov. 26, 1984, now abandoned.

BACKGROUND OF THE INVENTION

1. Field of the Invention

The present invention relates to a steel cord for radial tire, and more particularly relates to a steel cord to be used in a carcass of a radial tire for truck and bus.

2. Description of the Prior Art

As the steel cord to be used in the carcass portion of a radial tire for truck and bus, there had previously been predominantly used a strand construction steel cord 7×4+1 illustrated in FIG. 1, but has recently been predominantly used a layer construction steel cord 3+9+15+1 illustrated in FIG. 2A. The reason is as follows. In the strand construction steel cord 7×4+1, filaments constituting the steel cord are brought into point contact with each other in their length direction, and are rubbed with each other in many portions, and hence the cord is not satisfactorily high in fatigue resistance and wear resistance. In order to obviate these drawbacks, a layer construction steel cord 3+9+15+1 has recently been used. In the layer construction steel cord 3+9+15+1, filaments constituting the cord are brought into line contact with each other, and are very slight in the mutual rubbing, and hence the cord is excellent in fatigue resistance and wear resistance, and has a long durable life.

The layer construction steel cord predominantly used at present is formed of 28 filaments twisted in a layer construction. The steel cord is indicated by the numeral 1 in FIG. 2A, and consists of 3 layers A, B and C, each of which consists of filaments 2, and a wrapping wire 3. In the layer construction cord illustrated in FIG. 2A, filaments constituting the outer layer C are compactly twisted such that substantially no clearance is formed between adjacent filaments, and the cord periphery of the layer construction cord illustrated in FIG. 2A is more smooth than the cord periphery of the strand construction cord 5 illustrated in FIG. 1, which has almost the same number of filaments as that of the cord illustrated in FIG. 2A. Further, when a cylindrical calendered material consisting of cords and unvulcanized rubber is inflated and is toroidally formed to build a tire having a given outer diameter as illustrated in FIG. 7, if a conventional compact cord is used, the amount of rubber to be penetrated between filaments is small, and the unvulcanized rubber is easily separated from the cord, and a vacant space is formed around the cord. That is, when a portion having a high stickiness between a cord and unvulcanized rubber, and a portion having a low stickiness between a cord and unvulcanized rubber are concurrently present in an intermingled state, a large vacant space and a small vacant space are formed around the cords, and the resulting carcass 6 has an uneven surface formed of non-periodically and irregularly arranged valleys a and mountains b as illustrated in FIGS. 8A and 8B, and the green tire 7 has an irregular outward appearance. When a reinforcing belt layer is superposed on the carcass having such irregular outward appearance in the next building step, the carcass portion and the belt portion are ununiformly stuck to each other to disturb the adhesion of rubber of the tire after vulcanization and to deteriorate the durable life of the tire.

Radial tires are required to have an accuracy remarkably higher in the dimension of parts materials and in the building of the tire than the accuracy required in bias tires due to the difference of the tire construction. It is generally known that the above described unevenness in the carcass surface of a green tire deteriorates noticeably the durable life of a vulcanized tire.

SUMMARY OF THE INVENTION

The object of the present invention is to eliminate the cause, by which the above described irregular unevenness is formed on the carcass surface of a green tire, and to prevent the formation an irregular outward appearance of a green tire.

The inventors have newly found out that the irregular outward appearance of a green tire due to the irregular unevenness formed on the carcass surface of the green tire (at the inflation step thereof) is caused by the ununiform sticking force between cords and unvulcanized rubber. This is due to ununiform penetration of the unvulcanized rubber into a cord, as well as to the twist construction of the cord. Based on this discovery, in the present invention, filaments have been previously spirally worked under properly selected twist pitch, twist tension, preform and the like, and then the filaments are twisted into a cord having a soft twist construction, which has proper clearances $\delta$ between adjacent filaments arranged in the outer layer C and between the outer layer C and the intermediate layer B in a steel cord as illustrated in FIG. 2B. The soft twist construction also having an elongation within the specifically limited range defined in the present invention under an ultra-low load and a low load, whereby the formation of an irregular outward appearance of a green tire is prevented.

That is, in a steel cord having a circular cross-section and a soft twist construction and having an elongation within the specifically limited range defined in the present invention under an ultra-low load and a low load, a large amount of rubber is penetrated into clearances $\delta$ between adjacent filaments and between adjacent cords, and the rubber sticks firmly to the cords along their outer periphery and to define clearly the profile of the cord, and hence the surface of the carcass 6 has periodically arranged valleys a' and mountains b' as illustrated in FIGS. 9A and 9B, and the green tire has regular outward appearance.

The feature of the present invention is provision of a steel cord for radial tire, comprising at least 10 metal filaments twisted into the steel cord, the steel cord having an elongation of 0.015–0.045% under a load of 0.5 kgf, an elongation of 0.025–0.060% under a load of 1 kgf, and an elongation of 0.060–0.114% under a load of 4 kgf, as shown by the region A in FIG. 10, assuming that the elongation under a load of 0.05 kgf is 0%.

DESCRIPTION OF THE PREFERRED EMBODIMENT

The present invention will be explained in more detail referring to the accompanying drawings.

Figure 10:
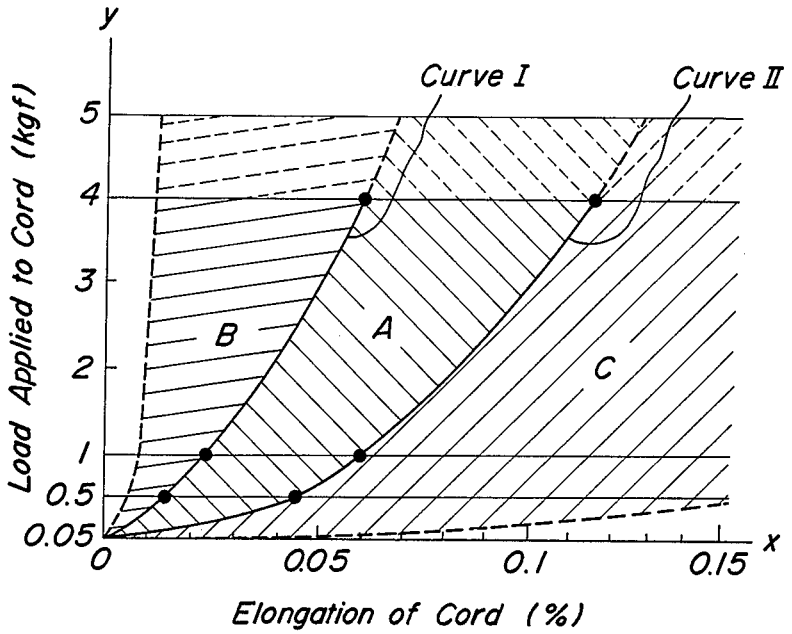
FIG. 10 is a graph illustrating the region A, which defines the load-elongation property of the steel cord of the present invention.

In FIG. 10, the region A is a region, which defines the load-elongation relation of the soft type twisted cord of the present invention; the region B is a region, which defines the load-elongation relation of a conventional compact type twisted cord; and region C is a region which defines the load-elongation relation of an open type twisted cord. In the region C, the twist is unstable and is irregular, and the cord is not suitable to be used as a cord for the carcass of a radial tire for truck and bus.

The region A in the present invention is shown by a range which lies between a curve I: $y=815.47x^2+18.09x+0.05$ and a curve II: $y=368.57x^2-6.59x+0.05$ wherein x represents the elongation (%) of a cord and y represents the load (kgf) applied to the cord and lying within the range of 0.05–4.00 kgf.

In the present invention, the elongation of a cord under a load of 0.05 kgf is assumed to be 0%. The reason is as follows. When the relation between the load applied to a cord and the elongation of the cord is measured, a tensile tester sold in the market is used in the measurement of the elongation of a twisted cord under an ultra-low load region. In this measurement, the elongation of the cord is indicated by the moved distance of a chuck. However, the chuck begins to move before a load is applied to a sample cord due to the variability of the lengths of the sample cords at the setting thereof, the very slightly curved shape of the sample cord itself, the sliding of the sample cord in the chuck and the like, and it is difficult to detect the true elongation of the cord due to the twist construction. Accordingly, the elongation of a cord under a load of 0.05 kgf is assumed to be 0%, which assumption is considered to be a proper for the practical evaluation of the elongation of the cord.

The sticking force between the cord and the unvulcanized rubber was measured in the following manner. A test piece of a unvulcanized rubber for a steel radial tire was placed on and pressed to cords, which have been arranged in a tightly contacted state with each other on a plain metal plate, and the assembly was heated up to a rubber temperature at the calendering in the manufacture of a tire, kept at this temperature for a given time, and then gradually cooled to room temperature. The sticking force between the cord and the unvulcanized rubber was evaluated by the tensile force required for separating the rubber piece from the cords by means of a tensile tester in a direction perpendicular to the direction of the plain metal plate.

After the above described test piece obtained by pressing the unvulcanized rubber to the cords so as to be used in the above described tensile test was vulcanized and cured at a temperature of 140° C., the test piece was cut, and the cross-section was observed by an optical microscope, and the area of the inside of the cord into which rubber penetrated through the clearance between filaments was measured. Further, the clearance between filaments was measured by a method, wherein a cord was embedded in and fixed to a transparent resin, the cord was cut, and then the cross-section of the cord was observed by an optical microscope.

The steel cord having the load-elongation characteristic property of the present invention can be manufactured by subjecting previously filaments to a spiral working under properly selected twist pitch, twist tension, preform and the like. When the load-elongation relation lies within the above described range A, the average value of the clearance δ between adjacent filaments is not less than 0.009 mm, and a large amount of unvulcanized rubber can be penetrated into the cord to give to the cord a satisfactorily high sticking force with the unvulcanized rubber. When the elongation of a cord under the above described load is lower than the lower limit of the elongation defined in the present invention, the cord has a conventional compact twist, has no clearance between adjacent filaments and is poor in the sticking force to unvulcanized rubber. When the elongation is higher than the upper limit, the twist is unstable and is irregular, and the cord is not suitable to be used as a carcass cord.

Figure 1:
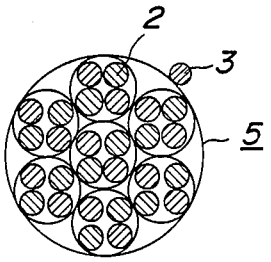
FIG. 1 is a cross-sectional view of a conventional compact type strand construction steel cord.
Figure 2A:
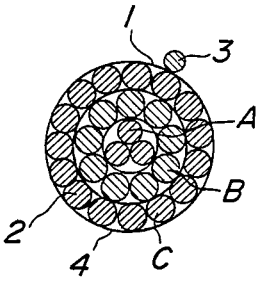
FIG. 2A is a cross-sectional view of a conventional compact type layer construction steel cord 3+9+15+1.
Figure 2B:
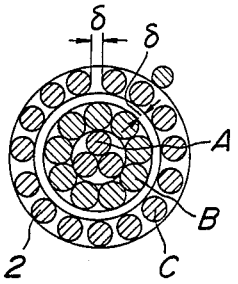
FIG. 2B is a cross-sectional view of a layer construction steel cord 3+9+15+1 according to the present invention.
Figure 3A:
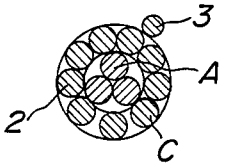
FIG. 3A is a cross-sectional view of a conventional compact type layer construction steel cord 3+9+1.
Figure 3B:
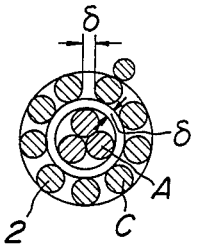
FIG. 3B is a cross-sectional view of a layer construction steel cord 3+9+1 according to the present invention.
Figure 4A:
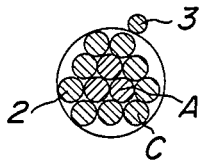
FIG. 4A is a cross-sectional view of a conventional compact type bunched construction steel cord 1×12+1.
Figure 4B:
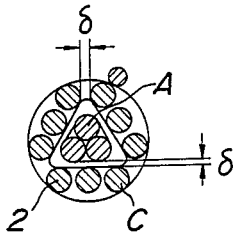
FIG. 4B is a cross-sectional view of a bunched construction steel cord 1×12+1 according to the present invention.
Figure 5A:
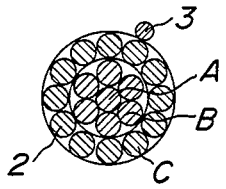
FIG. 5A is a cross-sectional view of a conventional compact type bunched construction steel cord 1×19+1.
Figure 5B:
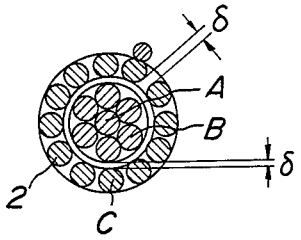
FIG. 5B is a cross-sectional view of a bunched construction steel cord 1×19+1 according to the present invention.
Figure 6A:
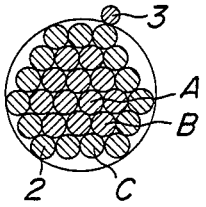
FIG. 6A is a cross-sectional view of a conventional compact type bunched construction steel cord 1×27+1.
Figure 6B:
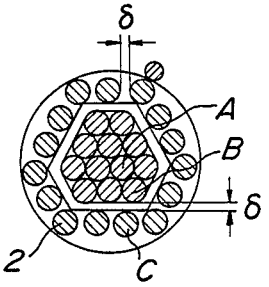
FIG. 6B is a cross-sectional view of a bunched construction steel cord 1×27+1 according to the present invention.
Figure 7:
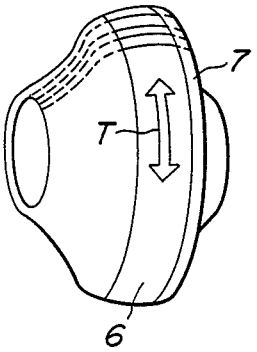
FIG. 7 is a perspective view of a toroidally deformed green tire.
Figure 8A:
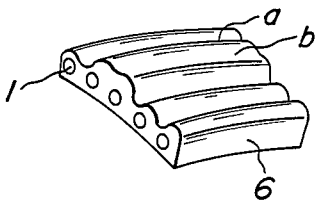
FIG. 8A is a perspective view of a part of the carcass portion of a green tire, which carcass portion contains the conventional layer construction steel cords illustrated in FIG. 2A and embedded in the carcass portion and has a surface having non-periodic unevenness.
Figure 8B:
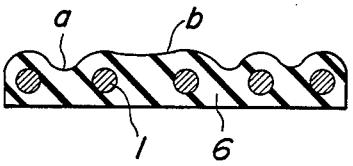
FIG. 8B is a sectional view of a part of the carcass portion of the conventional green tire illustrated in FIG. 8A.
Figure 9A:
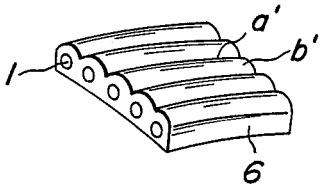
FIG. 9A is a perspective view of a part of the carcass portion of a green tire, which carcass portion contains the layer construction steel cords of the present invention illustrated in FIG. 2B and embedded in the carcass portion and has a surface having periodic unevenness.
Figure 9B:
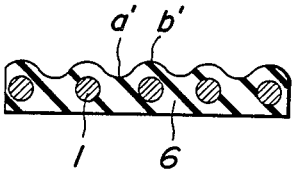
FIG. 9B is a sectional view of a part of the carcass portion of the green tire of the present invention illustrated in FIG. 9A.

The present invention can be applied to layer construction cords and bunched construction cords to be used in the carcass of a tire for truck and bus, for example layer construction cords 3+9+1 (refer to FIGS. 3A and 3B) and 3+9+15+1 (refer to FIGS. 2A and 2B); and bunched construction cords 1×12+1 (refer to FIGS. 4A and 4B), 1×19+1 (refer to FIGS. 5A and 5B) and 1×27+1 (refer to FIGS. 6A and 6B). FIGS. 2A, 3A, 4A, 5A and 6A illustrate conventional compact type steel cords, which have no clearance between adjacent filaments in the outer layer C and have a compact type twist. On the contrary, FIGS. 2B, 3B, 4B, 5B and 6B illustrate steel cords of the present invention which have proper clearance between adjacent filaments in the outer layer C, and between the outer layer C and the intermediate layer B, or between the outer layer C and the inner layer A, and have a soft type twist.

In the present invention, as the unvulcanized rubber to be coated on the steel cord, there can be used unvulcanized rubber having a modulus, after vulcanization, of 15–35 kgf/cm$^2$ in 50% modulus, 30–65 kgf/cm$^2$ in 100% modulus and 70–140 kgf/cm$^2$ in 200% modulus.

Methods for improving the amount of rubber to be penetrated into clearances between adjacent filaments in a cord during the vulcanization of the rubber are disclosed in U.S. Pat. No. 4,258,543, U.S. Pat. No. 4,399,853 and the like. The cords disclosed in these prior arts are ones having a load-elongation characteristic property corresponding to that shown by the region C in FIG. 10. That is, these prior arts disclose a cord having an open type twist, and aim to improve the corrosion resistance of a cord to be used in the belt portion of a passenger car. On the contrary, the present invention discloses a cord to be used in the carcass portion of a radial tire for truck and bus, and aims to produce a cord capable of forming a green tire having a highly regular unevenness in its carcass surface before vulcanization. Therefore, these prior arts are entirely different from the present invention in the object, the usable range of elongation and the usable portion of the tire.

The following example is given for the purpose of illustration of this invention and is not intended as a limitation thereof.

EXAMPLE

Eight kinds of layer construction steel cords 3+9+15+1 having different elongations were produced from a brass-plated steel wire having a diameter of 0.175 mm used as a filament, and the relation between the load and elongation of the cords, the sticking force of unvulcanized rubber to the cords, the penetrated area of rubber into the inside of the cord, and the outward appearance of tires using the cords were examined. The obtained results are shown in the following Table 1. In Table 1, the elongation of the cords was measured by means of a precision tensile tester made by Instron Co. The sticking force of the unvulcanized rubber to the cords was measured by a method, wherein an unvulcanized rubber test piece of 10 mm×15 mm×1.1 mm (thickness) was pressed and stuck to three cords, which had been arranged in a tightly contacted state with each other on a plain metal plate, under heating at a temperature of 80° C., and the resulting assembly was left to stand and cooled to room temperature, and then the rubber piece was separated from the cords by means of the tensile tester, and the tensile force required for the separation was measured.

The area of the cord into which rubber penetrated was measured by a method, wherein the above obtained assembly of the rubber test piece and three cords was sulfur-vulcanized and cured at 140° C. for 3 hours and the area of the cord into which rubber penetrated was read from an enlarged photograph of 100 magnifications of the cross-section of the cord. Further, the clearance between adjacent filaments in a cord was measured by a method, wherein the cord was fixed with a transparent acrylic resin, and then the clearance was measured from an enlarged photograph of 100 magnifications of the cross-section of the cord.

TABLE 1

| Sample | Region | Elongation of cord (%) under a load of 0.05 kgf | under a load of 0.5 kgf | under a load of 1 kgf | under a load of 4 kgf | Sticking force of unvulcanized rubber to cord (gf) | Penetrated area of rubber into cord (mm$^2$) | Average clearance δ between adjacent filaments (mm) | Outward appearance of a green tire |
|---|---|---|---|---|---|---|---|---|---|
| 1 Comparative example | B | 0 | 0.010 | 0.016 | 0.045 | 1.967 | 0.0108 | 0.007 | irregular |
| 2 Comparative example | B | 0 | 0.012 | 0.019 | 0.050 | 2.030 | 0.0120 | 0.008 | irregular |
| 3 Present invention | A | 0 | 0.015 | 0.025 | 0.060 | 2.147 | 0.0125 | 0.009 | regular |
| 4 Present invention | A | 0 | 0.026 | 0.035 | 0.069 | 2.317 | 0.0135 | 0.009 | regular |
| 5 Present invention | A | 0 | 0.027 | 0.037 | 0.077 | 2.583 | 0.0156 | 0.010 | regular |
| 6 Present invention | A | 0 | 0.039 | 0.055 | 0.105 | 2.912 | 0.0183 | 0.013 | regular |
| 7 Comparative example | C | 0 | 0.047 | 0.062 | 0.116 | 3.100 | 0.0200 | 0.015 | Irregular twist begins to occur in a cord. The cord is unsuitable as a carcass cord. |
| 8 Comparative example | C | 0 | 0.054 | 0.071 | 0.119 | 3.230 | 0.0210 | 0.017 | A large amount of irregular twists occur in a cord. The cord is unsuitable as a carcass cord. |

Note: Region is region A, B or C in FIG. 10.

Figure 11:
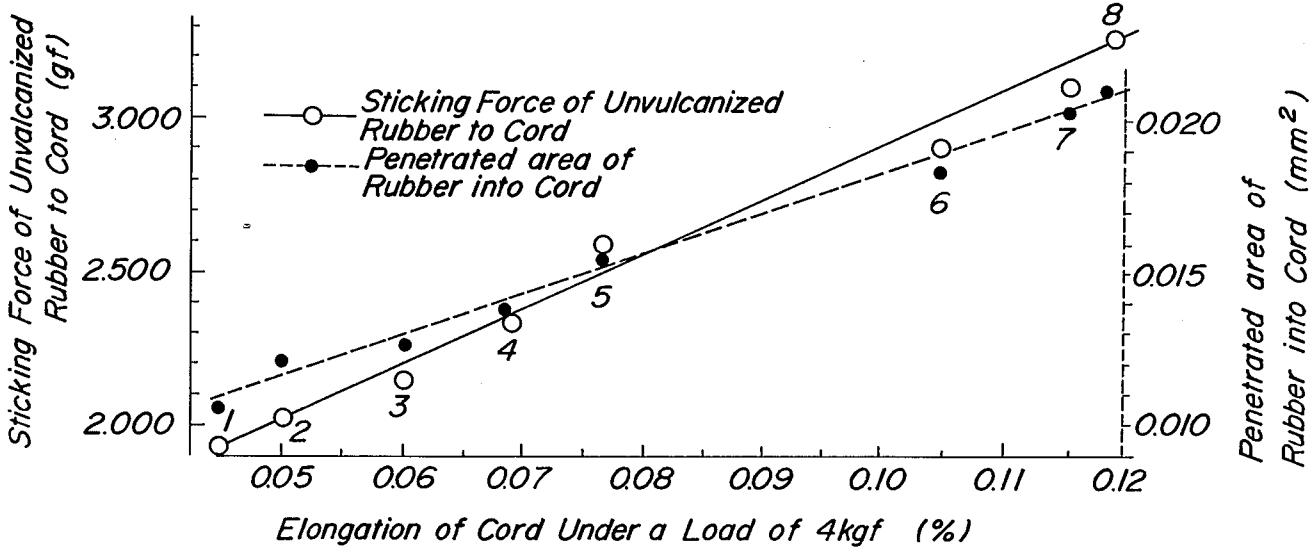
FIG. 11 is a graph illustrating relations between the elongation of a cord under a load of 4 kgf and each of the sticking force of the cord to unvulcanized rubber and the penetrated area of the rubber into the cord.

FIG. 11 is a graph obtained by plotting relations between the elongation (%) of the cord under a load of 4 kg and each of the sticking force of the unvulcanized rubber to the cord and the penetrated area of the rubber into the cord shown in Table 1. The cords of sample Nos. 1 and 2 of comparative example have a sticking force to unvulcanized rubber of less than 2.100 gf, and give a green tire having an irregular outward appearance. The cords of sample Nos. 3–6 of the present invention have a high sticking force to unvulcanized rubber and a large rubber penetrated area of the cord. The cords of sample Nos. 7 and 8 of comparative example have a high elongation and a high sticking force to unvulcanized rubber, but cause irregular twists and are not suitable to be used in the manufacture of tire.

What is claimed is:

1. A radial tire twisted-steel cord of circular cross-section comprising at least ten metal filaments which are multi-layered and in a soft twist configuration, comprising an outer layer of said filaments being arranged with a clearance of between 0.009 and 0.015 mm between adjacent filaments in said outer layer and between the outer layer and the adjacent inner layer, the cord having a load-elongation characteristic which lies between:

a curve I defined by the relationship $y=815.47x^2+18.09x+0.05$ and a curve II defined by the relationship $y=368.57x^2-6.59x+0.05$, where x represents the elongation (%) of a cord and y represents the load (kgf) applied to the cord, and lying within the range of 0.05–4.00 kgf, and said steel cord having an elongation of 0.015–0.045% under a load of 0.5 kgf, an elongation of 0.025–0.060% under a load of 1 kgf, and an elongation of 0.060–0.114% under a load of 4 kgf, when the elongation under a load of 0.05 kgf is 0%.

* * * * *

UNITED STATES PATENT AND TRADEMARK OFFICE

CERTIFICATE OF CORRECTION

PATENT NO. : 4,763,466

DATED : August 16, 1988

INVENTOR(S) : Hideo ABE; Takaaki HIRA; Toru SASAKI; Keiji KUMAGAI; Kunihiko KATAOKA; and Takashi SASAKI It is certified that error appears in the above-identified patent and that said Letters Patent are hereby corrected as shown below:

Title page, item [30]

Delete "Dec. 29, 1984 [JP]" and substitute

--Dec. 29, 1983 [JP]--.

Signed and Sealed this

Thirteenth Day of December, 1988

*Attest:*

DONALD J. QUIGG

*Attesting Officer*

*Commissioner of Patents and Trademarks*